US006021550A

United States Patent [19]

Welch

[11] Patent Number: 6,021,550

[45] Date of Patent: Feb. 8, 2000

[54] REMOVABLE SELF ADHERING TABS FOR NAPKINS

[76] Inventor: Charles D. Welch, 38 Pembroke St., Kingston, Mass. 02364

[21] Appl. No.: 09/133,222

[22] Filed: Aug. 13, 1998

[51] Int. Cl.[7] ..... A44B 17/00; A45F 5/00

[52] U.S. Cl. ..... 24/7; 24/304; 24/DIG. 11

[58] Field of Search ..... 24/7, 8, 9, 304, 24/306, 13, 66.1, 448, DIG. 11; 248/205.3

[56] References Cited

U.S. PATENT DOCUMENTS

| | | | |
|---|---|---|---|
| 747,467 | 12/1903 | McMeeser | 24/7 |
| 2,009,831 | 7/1935 | Yerzley | 24/7 |
| 2,532,011 | 11/1950 | Dahlquist et al. | 24/DIG. 11 |
| 2,803,574 | 8/1957 | Payant | 154/53.5 |
| 2,902,734 | 9/1959 | Walters | 24/7 |
| 3,257,677 | 6/1966 | Batchelder et al. | 24/DIG. 11 |
| 3,350,045 | 10/1967 | Mayers | 24/DIG. 11 |
| 3,398,438 | 8/1968 | Fried et al. | 24/7 |
| 3,398,439 | 8/1968 | Fried et al. | 24/7 |
| 3,766,676 | 10/1973 | Slemmons | 40/158 A |
| 3,862,634 | 1/1975 | Small | 128/284 |
| 3,900,645 | 8/1975 | Morgan | 428/41 |
| 3,913,655 | 10/1975 | Ogino | 160/84 R |
| 3,947,896 | 4/1976 | Taylor | 24/DIG. 11 |
| 4,299,223 | 11/1981 | Cronkite | 128/287 |
| 4,530,867 | 7/1985 | Gorman | 428/41 |
| 4,587,146 | 5/1986 | Anhäuser et al. | 428/41 |
| 4,602,971 | 7/1986 | Bergeron et al. | 156/94 |
| 4,605,292 | 8/1986 | McIntosh | 248/205.3 |
| 5,030,491 | 7/1991 | Shoesmith | 428/41 |
| 5,498,455 | 3/1996 | Roberts | 428/40 |

*Primary Examiner*—Victor N. Sakran
*Attorney, Agent, or Firm*—Perkins, Smith, Cohen, LLP

[57] ABSTRACT

A tab for securing a napkin to a user. The tab has one adhesive surface for attaching to the user with a second adhesive surface for attaching to a napkin. The tabs adhesive surfaces have a protective covering that is peelable when used. The tab will have at least two adhesive surface areas, either opposing or on the same side of the tab. Each adhesive area will have a removable protective covering that is removed when the now exposed adhesive is to be used. The tabs are thin and flexible, with the two sides formiing substantially the entire exposed surface area of the tabs. The adhesive may be any suitable for the napkin material or the cloth or other material that the napkin is to protect. In addition, the tabs and the napkins may be made with shapes and/or logos suitable for promotional or special uses, for example, for children. The shapes and logos may be of character personalities, cartoon characters, animals and/or graphical designs of any sort.

4 Claims, 3 Drawing Sheets

REMOVABLE SELF ADHERING TABS FOR NAPKINS

FIELD OF THE INVENTION

The present invention relates to self adhering tabs suitable for removably attaching to a user and to which a napkin or protective covering may be removably attached to shield the user or an area from spills, and more particularly to tabs to which napkins are attached and draped over a person for protection from food and drink spills.

BACKGROUND OF THE INVENTION

Cloth and paper napkins have been long in use to protect a diner from food and drink spills. These napkins are usually tucked under the chin or laid on the lap of the user. One problem associated with such napkins and their use is that they are not easily kept in place. They move or inadvertently fall to the floor often unnoticed by the user, and so offer no protection. Although these napkins may be pinned to the user, such pinning is inconvenient and is rarely used for others than infants.

Fine restaurant provide high quality cloth napkins, which suffer the above limitations, as they are not attachable to the user (not considering tucking it under the chin). These cloth napkins are economical since they can be washed and reused substantially eliminating the cost of the napkin. But, cloth napkins are rarely used outside of restaurants and/or formal dinners, since they offer little protection but entail overhead of washing and folding.

Bibs for children are known that have VELCRO, buttons, zippers, or snap attachments that are permanently attached or are part of the bib or napkin. These bibs are made of cloth and are usually wrapped and attached around the neck of the child. These bibs are washable and reusable for economical use. However, the permanent attachment means may be unwanted for other uses or at other occasions, and so may prevent the use of these bibs in other situations. Another limitation of these bibs is that the design of these bibs often precludes, from a practical view, use for an adult or an older child wanting a napkin laid on his or her lap.

Self adhering tabs permanently attached to disposable diapers are known, for example, U.S. Pat. No. 3,862,634 to Small, and U.S. Pat. No. 4,299,223 to Cronkrite. Moreover, self adhering laminates with peelable coverings and other such members are known. However, this prior art is not convenient nor applicable, nor is there any teaching or suggestion of changing and applying these inventions to napkins.

Other prior art napkins have been disclosed for example, in U.S. Pat. No. 2,009,831 to Yerzley, U.S. Pat. No. 2,803,574 to Fayant, and U.S. Pat. No. 3,398,438 and 3,398,439 both to L. Fried et al. However, in each of these patents the invention is the napkin itself with an attachment means adhered.

U.S. Pat. No. 2,902,734 to Walters is entitled a Napkin Fastening Means which is separable from the napkin. The Walter's fastener is a doubled over flexible strip which is relatively complex and expensive to produce, and in some instances inconvenient to use. The multiple folds enclose and protect the adhesive parts to prevent the fastener from sticking to itself or unwanted areas on the napkin or elsewhere, but the folds add to the complexity and cost. The fastener is fitted with two PULL and HOLD areas that do not participate in the adhesion of the fastener. These areas are for the convenience of the user to pull open the fastener, but these added areas also add to the size and the cost of the fastener. These areas are inherently visible when in use, and such visibility may be undesirable in practical applications where individual users may be sensitive to the obvious use to others of the fasteners. These limitations of the Walters fastener may provide an impediment to wide spread use of this fastener.

The folding of the strip of material in the Walters' fastener allows the adhesive areas to be exposed with no throw away material, and the fastener may be refolded back for future use. These are cited advances in the art and features of the Walters' fastener. But, as discussed above, these features add to the complexity and therefore the cost of Walters' fastener. These features also are structural differences compared to the present tab. The present tab is a flat, inexpensively manufactured structure which has a removable protective covering over the adhesive surface(s). The covering is totally removed and the tab is placed on the area to be protected and on the napkin. In cintrast to the Walters' fastener, the present invention has throw away coverings and may be worn entirely hidden or purposely exposed.

It is an object of the present invention to provide a tab for holding a napkin that can be securely but removably placed virtually anywhere on the user's clothing.

It is another object of the present invention to provide for an inexpensive, easy to use tab for holding a napkin that encourages greater use of napkins.

Still another object of the present invention is to provide a tab for attaching a napkin to a user where two separate adhesive areas are exposed independently for use. This allows the present invention to be conveniently used where the tab is attached to the user at one time, and at some quite later time attached to the napkin.

It is another object of the present invention to provide a tab that may be completely hidden from view when in use.

It is another object to provide a means for attaching a napkin or other shield made of cloth, paper, leather or virtually any material securely wherever a user may want it. A related object is the encouragement for greater use of cloth napkins outside of restaurants.

Yet another object of the present invention is to provide means for restaurants and companies to provide an economical complimentary tab for napkins that will be used by the recipient since the napkins can be securely placed on the user ensuring the protection to the user.

SUMMARY OF THE INVENTION

The foregoing objects are met in a tab that has two adhesive attachments areas each area with a separate peelable protective covering. Tab is used herein as a general descriptive or generic term and are not used herein to indicate any specific size, shape or composition of material. The tab can be of any size or shape convenient for a particular application. The adhesive can be of any type known in the art which can be used to advantage.

In preferred embodiments, the two adhesive attachment areas may be on one side of the tab, and in other preferred embodiments the attachment areas may be on opposite sides.

In preferred embodiments the tab will be thin flexible body where the two opposing sides present two surface areas that are substantially the entire surface areas of the tab. In a preferred embodiment, the periphery surface area representing the thickness of the tab usually being negligible. Both of the two surface areas may be adhesives areas with protective coverings, or one may be a non-adhesive and the second an adhesive surface area. However, in the latter case, the second adhesive surface area will have two protective removable coverings.

Removing one protective covering allows the tab to be secured to a user or a location to be protected. Removing the second protective cover allows the napkin to be secured to the tab. Of course several tabs may be used in combination. In this preferred embodiment the tabs are completely hidden from view.

In another preferred embodiment, especially when the tab has one adhesive surface area, the other non-adhesive surface area will be viewable by others. The viewable tab can be in the form of a character personality or graphical design that may be used for promotional purposes.

Other objects, features and advantages will be apparent from the following detailed description of preferred embodiments thereof taken in conjunction with the accompanying drawings in which:

DETAILED DESCRIPTION OF PREFERRED EMBODIMENTS

Figure 1A:
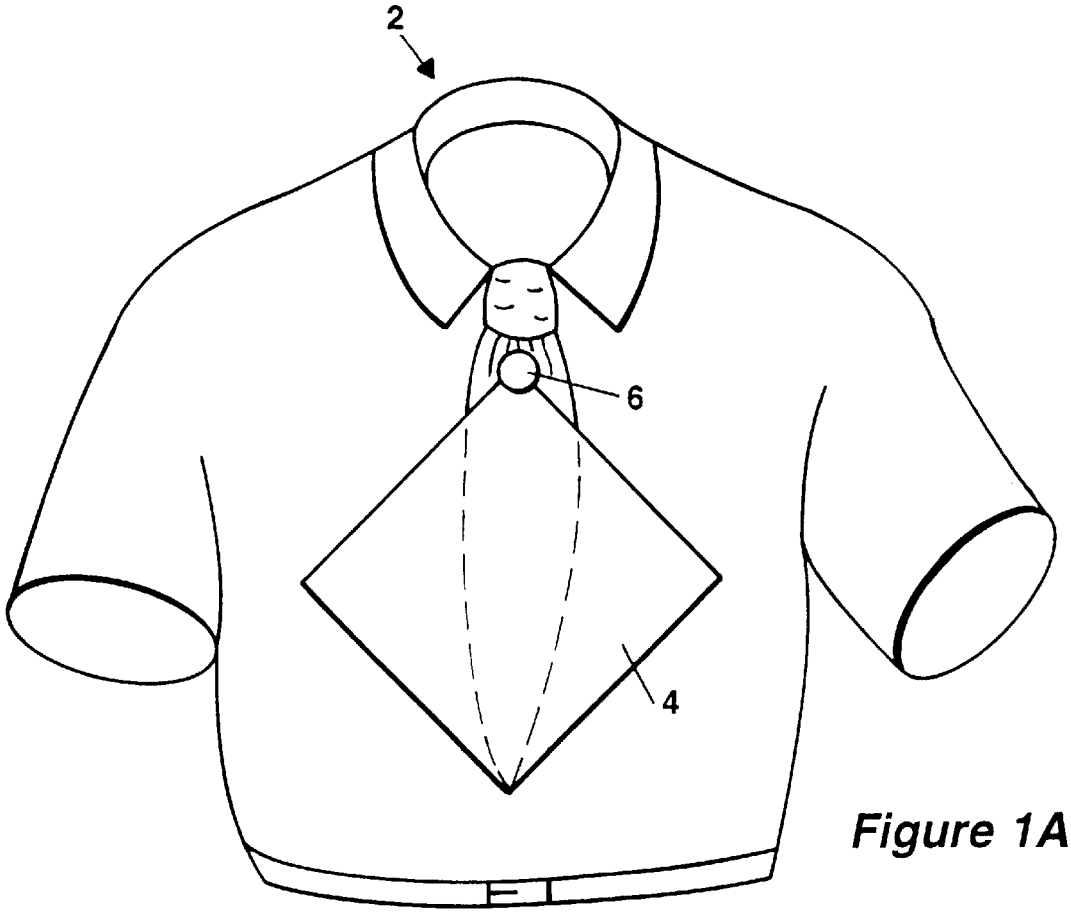
FIG. 1A is a pictorial view of a preferred embodiment of the present invention.

FIG. 1A shows a user's shirt and tie 2 with a napkin 4 attached to the tie. In this preferred embodiment, the napkin material could be made of paper, leather, cloth, etc. An attachment tab 6, made in accordance with the present invention, has two adhesive sides with one side adhering to the tie and the other side adhering to the napkin. In this embodiment, the entire tab is hidden from view by the napkin.

Figure 1B:
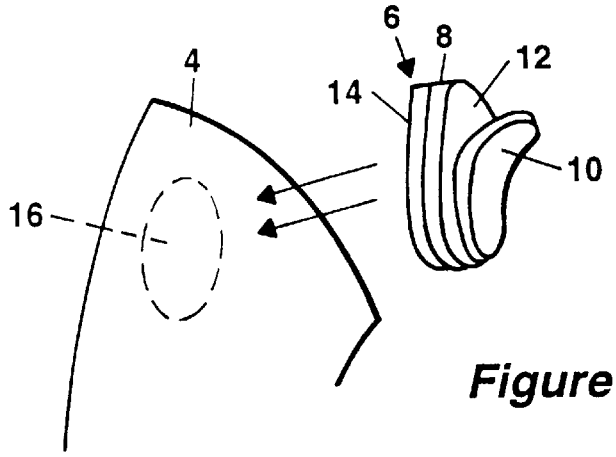
FIG. 1B is a pictorial view of a napkin and an attachment tab.

FIG. 1B shows the napkin 4 and the tab 6. In this preferred embodiment the tab is circular with a flexible, strong base 8 with two peelable protective coverings 10 and 14 on either side. The base 8 has adhesive on both sides, and when the peelable covering 10 is pulled away the adhesive surface 12 is exposed. The tab may be attached to the user where desired, and then the protective covering 14 may be removed exposing the second adhesive area to which the napkin 16 may be attached. The other adhesive surface will also be exposed when the peelable protective covering 14 is peeled away. Of course, the tab may be first attached to the napkin and then the combination napkin and tab placed on the user.

Figure 2A:
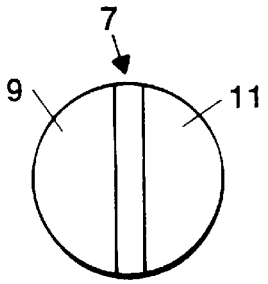
FIG. 2A is a view of an attachment tab with attachment areas on one side.
Figure 2B:
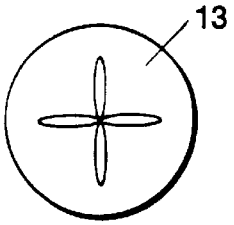
FIG. 2B is a view of the opposite side of the attachment tab of FIG. 2B.
Figure 2C:
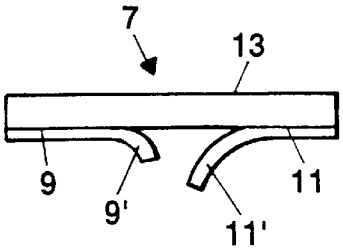
FIG. 2C is a side view of the attachment tab of FG. 2B.
Figure 2D:
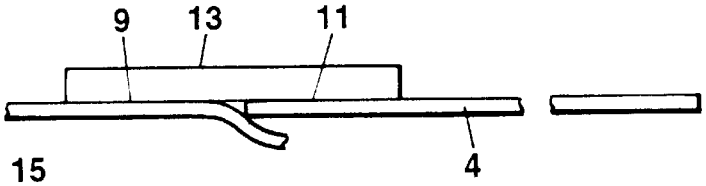
FIG. 2D is a side view of the attachment tab of FIG. 2B attaching a napkin to a shirt.
Figure 2E:
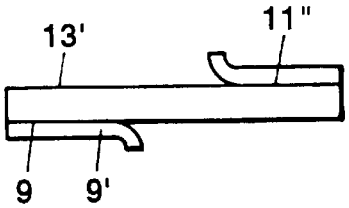
FIG. 2E is a side view of another preferred embodiment of an attachment tab with attachment areas on two sides.
Figure 2F:
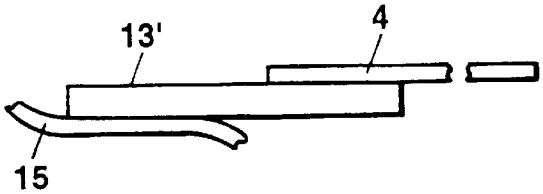
FIG. 2F is a side view of the attachment tab of FIG. 2F attaching a napkin to a shirt.

FIG. 2A shows another preferred embodiment of the inventive tab 7 with two adhesive areas 9 and 11 that have peelable protective coverings on one side of the tab. FIG. 2B shows the opposite side 13 where a decorative detail may be placed. FIG. 2C shows the tab 7 with the protective coverings 9' and as being partially peeled away from the adhesive areas 9 and 11. FIG. 2D shows a side view of the tab attached to a shirt 15 at the adhesive attachment area 9 and to the napkin 4 at the attachment areas 11. The outer surface 13 may have a decorative or promotional artifact thereon. FIG. 2E shows another embodiment where the attachment areas are on opposite sides of the tab. However, there attachment area 11" may only cover a portion of the surface area of the tab allowing a viewable areas 13' where a decorative or promotional artifact may be placed. The peelable tabs are shown partially peeled. FIG. 2F shows the tab of FIG. 2E attaching a napkin 4 to the shirt 15. The area 13' is viewable in this arrangement.

Figure 4:
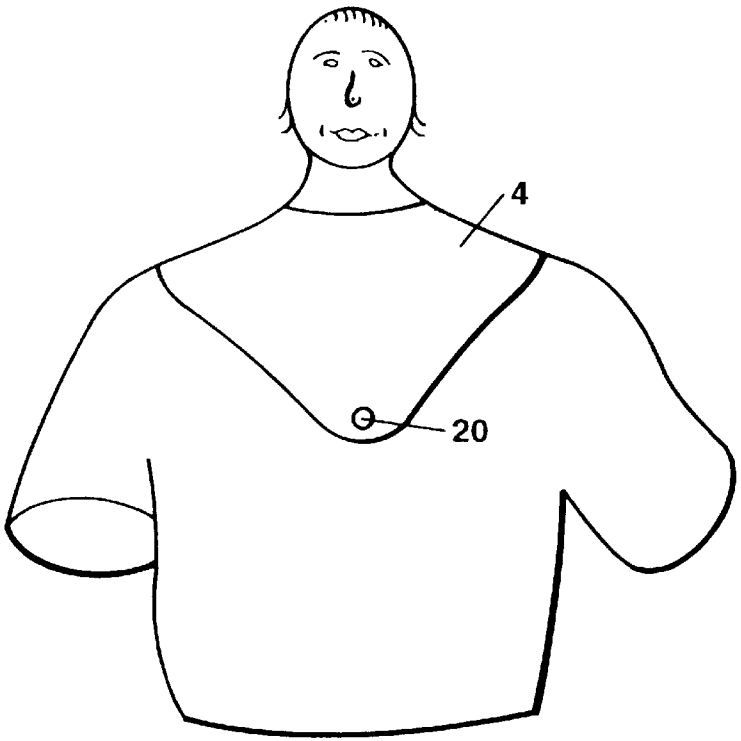
FIG. 4 shows the front view of the child of FIG. 3.
Figure 3:
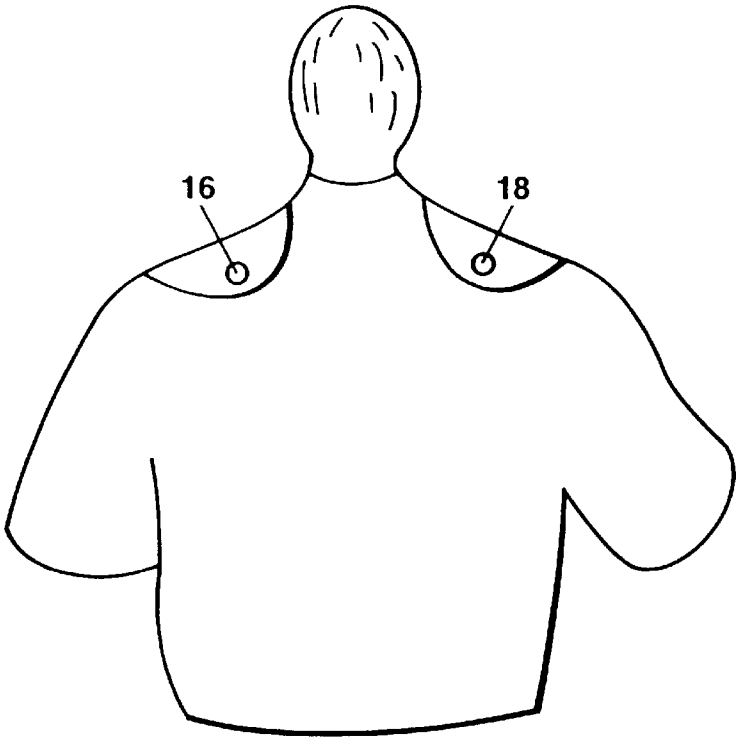
FIG. 3 shows a back view of use of the invention on a child.

FIG. 3 shows another preferred embodiment where a napkin is placed over and around the shoulders of a child. There are two tabs 16 and 18 that attach the napkin securely to the back of the child, and, as shown in FIG. 4, another tab 20 in the front that secures the napkin to the front of the child. Other tabs may be used as needed.

Figure 5:
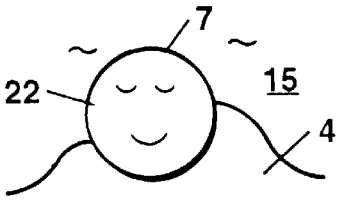
FIG. 5 shows a character personality form of a tab.

The tab may be made of any shape, including in the form of logo's, character personalities (for example cartoon characters), animals, letters or graphical drawings, designs or symbols, etc. FIG. 5 shows the inventive tab in the shape of a happy face with the appropriate graphics. In a preferred embodiment, the tab is made into the shape or a logo or well known character associated with a fast food restaurant catering to children, where the business gives away the tabs and/or napkins for promotional use.

Preferably the tab will be made of a thin flexible material, but the tab may be rigid.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A tab for securing a napkin to a location for protection against spills comprising:

a substantially flat body defining a first and a second side, the first side constructed and arranged for viewing when said tab is securing a napkin to said location;

the second side constructed and arranged with a first adhesive surface and a second adhesive surface, wherein said two adhesive surfaces are separate from each other, and protection means for removably covering said first and said second adhesive surfaces; wherein, by removing the means for removably covering, one adhesive surface is secured to the napkin and the second adhesive surface is attached to said location with said first side remaining viewable.

2. The tab as defined in claim 1 wherein the protection means for removably covering comprises a first means for removably covering the first adhesive surface, and a second separate means for removably covering the second adhesive surface.

3. The tab as defined in claim 1 wherein the second side is constructed and arranged with a non-adhesive surface separating said first adhesive surface and said second adhesive surface.

4. The tab as defined in claim 1 wherein said first side comprises a shape or logo or artifact formed or printed on said first side.

* * * * *